US007364012B2

(12) United States Patent
White, Jr.

(10) Patent No.: US 7,364,012 B2
(45) Date of Patent: Apr. 29, 2008

(54) DUAL-NECK PLANE WAVE RESONATOR

(75) Inventor: John A. White, Jr., Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 255 days.

(21) Appl. No.: 11/198,481

(22) Filed: Aug. 5, 2005

(65) Prior Publication Data

US 2007/0029134 A1 Feb. 8, 2007

(51) Int. Cl.
*F01N 1/02* (2006.01)
*F02M 35/12* (2006.01)

(52) U.S. Cl. ..... 181/250; 181/276; 123/184.57

(58) Field of Classification Search ..... 181/250, 181/266, 273, 276; 123/184.57, 184.53
See application file for complete search history.

(56) References Cited

U.S. PATENT DOCUMENTS 3,543,878 A * 12/1970 Hamilton ..... 181/228
3,967,446 A 7/1976 Harralson et al.
4,209,076 A * 6/1980 Franco et al. ..... 181/272
4,239,461 A 12/1980 Elson
4,424,882 A 1/1984 Moller
4,441,576 A 4/1984 Allen
4,475,867 A 10/1984 Smith
4,501,341 A 2/1985 Jones
4,645,031 A * 2/1987 Omura et al. ..... 181/232
4,892,168 A * 1/1990 Sasaki et al. ..... 181/250
5,014,816 A 5/1991 Dear et al.
5,096,010 A 3/1992 Ojala et al.
5,134,977 A 8/1992 Bagger et al.
5,173,577 A 12/1992 Clegg et al.
5,778,081 A 7/1998 Patrick
5,783,780 A 7/1998 Watanabe et al.
5,996,733 A 12/1999 DeTuncq et al.
6,009,705 A * 1/2000 Arnott et al. ..... 60/312
6,533,064 B1 3/2003 Kim et al.
6,609,489 B1 8/2003 Slopsema et al.
6,814,041 B1 11/2004 Cheng et al.
6,938,601 B2 * 9/2005 Fukumoto ..... 123/184.57
7,077,093 B2 * 7/2006 Koelmel et al. ..... 123/184.57
2006/0065479 A1 * 3/2006 Okawa et al. ..... 181/250

OTHER PUBLICATIONS

Eversman, W. and Ricci, G., Dec. 1987, "A Multiple Degree of Freedom Cavity Element for Acoustic Transmission Line"s presented at the Winter Annual Meeting, Boston, MA of the American Society of Mechanical Engineers.
Eversman, W. 1986, "A Systematic Procedure for the Analysis of Multiply Branched Acoustic Transmission LInes," ASME Journal of Vibration, Acoustics, Stress and Reliability in Design, vol. 109, pp. 168-177.

* cited by examiner

*Primary Examiner*—Edgardo San Martin
(74) *Attorney, Agent, or Firm*—Paul L. Marshall

(57) ABSTRACT

A resonator and method of designing a resonator including a cavity having an effective length that exceeds λ/8 such that a standing wave having an anti-node will form in the cavity. First and second necks each having first ends are attached to and in fluid communication with the cavity, the first neck being positioned adjacent the anti-node and thereby operable to interfere with said standing wave.

12 Claims, 3 Drawing Sheets

S - PIPE AREA
L - PIPE LENGTH

DUAL-NECK PLANE WAVE RESONATOR

TECHNICAL FIELD

The present invention relates to resonators used to reduce noise emanating from the induction system of an engine, and more particularly relates to a resonator having an unconventionally long cavity and two necks for coupling to an air intake of an automobile engine induction system.

BACKGROUND OF THE INVENTION

Side branch resonators have been used for many years to reduce radiated induction noise in automobile engine compartments. In one common application, a resonator having a cavity includes a neck interconnecting the cavity to the air intake duct of the engine induction system. The compartment and hence cavity are typically tube or rectangular shaped and there may be one or more necks (see, for example, U.S. Pat. No. 6,609,489). The parameters of cavity, neck length and neck diameter dictate at what frequency the resonator will resonate. The resonating frequency is chosen to match the frequency of the induction noise. Thus, when designing a resonator, the engineer will choose the cavity and neck diameter and length to achieve a resonating frequency that will match and cancel the frequency of the induction noise it is desired to attenuate.

The strength of the resonator is proportional to the square root of the cavity volume for a constant neck size. Thus, strong resonators require a large resonator cavity, however, large cavity size may not be feasible due to space constraints in the engine compartment. In other words, the available space dictates how large the engineer can make the cavity in terms of length, width and depth. Another potential problem is that making one dimension much larger than the other two will cause the resonator cavity to exhibit plane wave behavior and the resonator will thus not resonate at the predicted frequency. The engineer is thus forced to reduce this dimension size until the plane wave behavior ceases, however, this reduces the resonator strength as well. It will thus be appreciated that resonator design has been limited by space availability and attempts to increase resonator strength through an increase in linear dimensions of the cavity are typically futile.

There therefore exists a need for an improved resonator and method for reducing induction noise emanating from an engine that provides strong attenuation while occupying a small space in the engine compartment.

SUMMARY OF THE INVENTION

The present invention addresses the above need by providing a resonator and method for attenuating induction noise in an engine that is both strong in attenuation and relatively small in size, particularly when compared to conventional resonators of similar strength.

In one aspect, the invention comprises a resonator having a cavity defined by a compartment that has a characteristic length that is longer than the characteristic length in conventional resonators. In conventional resonator theory, any linear dimension or characteristic length cannot exceed the maximum allowable length which is equal to the wavelength "λ" divided by 8. Knowing that wavelength equals the speed of sound "c" divided by the tuning frequency "Fr", no linear dimension can exceed the speed of sound divided by the product of 8 times the frequency (maximum allowable length <c/(8×Fr). For example, in a conventional resonator, an engineer designing a 200 Hz resonator would know that the cavity will have a maximum allowable length of 0.7 ft. or 8.4 inches where c=1125 ft/sec.

In a second aspect, the invention comprises a resonator having first and second necks that interconnect the cavity to the air intake duct. Since the inventive resonator exceeds the maximum allowable length of conventional side branch resonators, a standing wave is formed in the cavity. This standing wave has an anti-node or high pressure zone that forms at an end of the cavity. One neck is positioned adjacent the anti-node and acts to eliminate the standing wave. The position of the other neck may be almost anywhere along the length of the cavity but preferably is no greater than the wavelength divided by 16 along the length of the induction system, or a quarter the length of the cavity, from the other neck. Importantly, since the inventive resonator cavity exceeds the maximum allowable length of conventional resonators and corresponding theory, the resonance frequency ($f_r$) of the inventive resonator is not predictable using the conventional resonator equation, which is as follows:

$$f_r=180\sqrt{(A_o\div(L_eV))} \quad \text{(Eq. 1)}$$

where:

$A_o$ is total neck area

V is compartment cavity $L_e$ is effective neck length

One method of predicting the resonance frequency of the inventive resonator is using three-dimensional finite elements which are used to describe the resonator and transmission loss is calculated with a finite element code. Three dimensional acoustic theory may be performed using computational vibro-acoustic software such as SYSNOISE by LMS Corporation). Another method is to use one-dimensional acoustic waves to calculate transmission loss. Characteristic dimensions such as tube length, tube area, neck length, neck area, neck separation distance and neck location are modeled with acoustic waves according to the acoustic wave equations explained more fully below.

BRIEF DESCRIPTION OF THE DRAWINGS

The present invention will now be described, by way of example, with reference to the accompanying drawings, in which.

DETAILED DESCRIPTION

Figure 1:
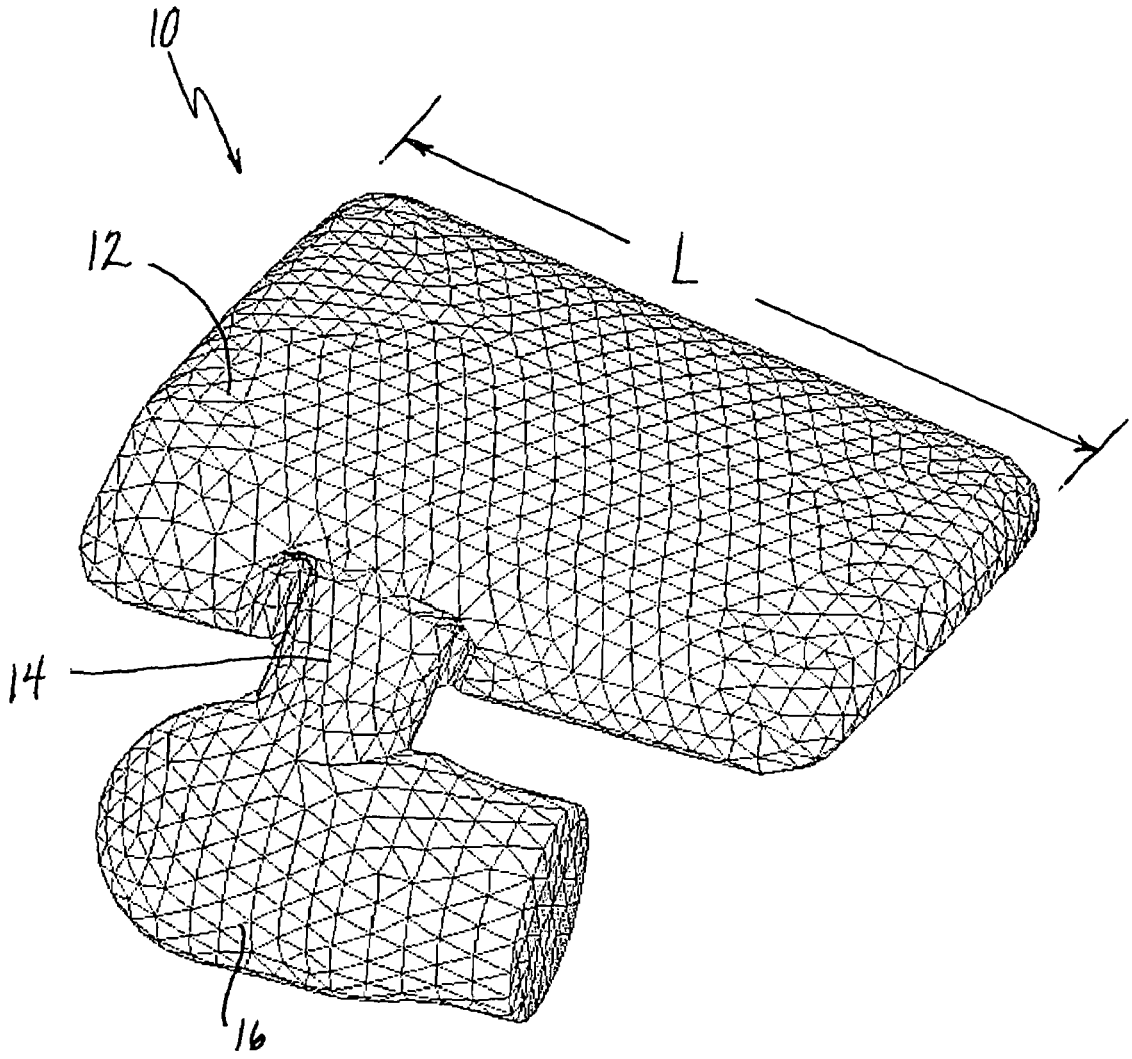
FIG. 1 PRIOR ART
FIG. 1 is a perspective view of a mesh form of a prior art side branch resonator used to reduce induction noise of an engine.

Referring to FIG. 1, a prior art conventional side branch resonator 10 is shown which is used for attenuating induction noise from an automobile engine (not shown). Prior art resonator 10 has two basic components: a compartment defining an internal cavity 12 and a neck 14 in fluid communication with cavity 12. The opposite end of the neck 14 connects to the intake duct 16 which leads to the induction system of the engine. Noise generated by the engine can travel and escape through the intake duct 16.

Resonator 10 is operable to reduce this undesirable "induction noise" by resonating at the frequency of the induction noise (the "induction frequency"), thereby creating pressure waves which, through the principle of interference, cancel the majority of the induction pressure waves at the resonance frequency. The strength (i.e., noise attenuation ability) of resonator 10 is limited by its size which, in turn, is limited by the available space in the engine compartment (not shown) as well as the diameter of the intake duct 16 to which neck 14 attaches.

The basic configuration of cavity 12 is a rectangular box-like structure and the resonance frequency is predicted according to the known equation:

$$f_r=180\sqrt{(A_o\div(L_eV))} \quad \text{(Eq. 1)}$$

where:

$A_o$ is total neck area;

V is compartment cavity; and $L_e$ is effective neck length.

The space constraints imposed on a resonator designer as explained above means that the resonator 10 will inevitably have a limited strength, i.e., resonator 10 may not be able to attenuate the entire induction noise being targeted. There frequently is limited space on top of the engine to attach a conventional shaped resonator volume due to low hood lines on modern cars. Smaller resonator volumes are less effective at attenuating noise, as is having to relocate the resonator further from the engine air intake due to space constraints.

Figure 2:
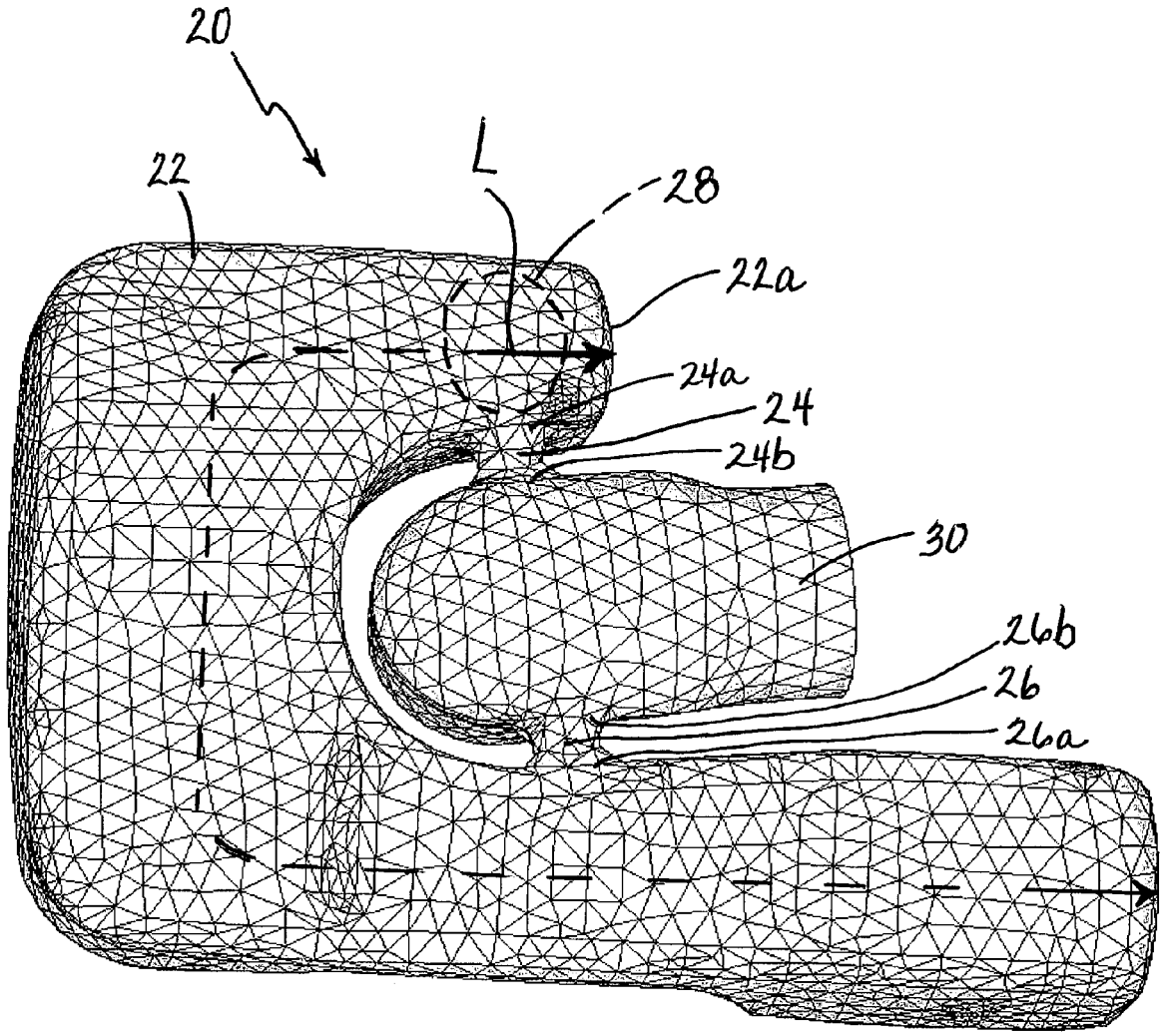
FIG. 2 is a top plan view of a mesh form of one possible embodiment of the inventive resonator.

The present invention provides a uniquely configured resonator which is stronger and more adaptable to fit into the available space than that possible with the design provided by prior art resonator 10. More particularly, as seen in FIG. 2, one possible embodiment of the invention is seen to comprise a resonator 20 for attaching to an air intake duct 30. Resonator 20 includes a cavity 22 defined by a compartment that has a characteristic length L that is longer than the characteristic length L in conventional resonators. Resonator 20 further includes first and second necks 24 and 26 that fluidly connect the cavity 22 at first ends 24*a*, 26*a* thereof, and to the air intake duct 30 at the opposite second ends 24*b*, 26*b* thereof, respectively.

The overall shape of the cavity 22 is unimportant and the designer thus has a large degree of freedom in shaping the cavity as needed or as dictated by the space constraints of the area where the resonator is required. Thus, in the embodiment of FIG. 2, the cavity is curved into a hook shape such that it extends around the air intake duct 30. This particular cavity shape effectively uses available space while at the same time having a relatively long cavity.

Since resonator 20 has a length L which exceeds the maximum allowable length of conventional side branch resonators, a standing wave is formed in the cavity 22. This standing wave has a high pressure zone or anti-node 28 that forms adjacent an end 22*a* of the cavity. One neck 24 is thus positioned adjacent the anti-node 28 and acts to eliminate the standing wave. The position of the other neck 26 may be almost anywhere along the length of the cavity as long as the neck ends 24*b*, 26*b* join the air intake duct along the same flow path plane. If neck ends 24*b*, 26*b* will not be positioned along the same flow path plane, they preferably are no greater than the wavelength λ divided by 16 along the length of the induction system, or about a quarter the length of the cavity, from each other.

As explained above, since the inventive resonator cavity 22 exceeds the maximum allowable length of conventional resonators and corresponding theory, the resonance frequency ($f_r$) of the inventive resonator is not predictable using the conventional resonator equation. There are two methods that can be used for calculating transmission loss (attenuation) of the resonator and both require computational analysis as is well understood to those skilled in the art.

One method of predicting the resonance frequency of the inventive resonator is using three-dimensional finite elements which are used to describe the resonator and transmission loss is calculated with a finite element code. In this method, three dimensional acoustic analysis is performed using well known computational vibro-acoustic software such as SYSNOISE by LMS International.

Figure 3:
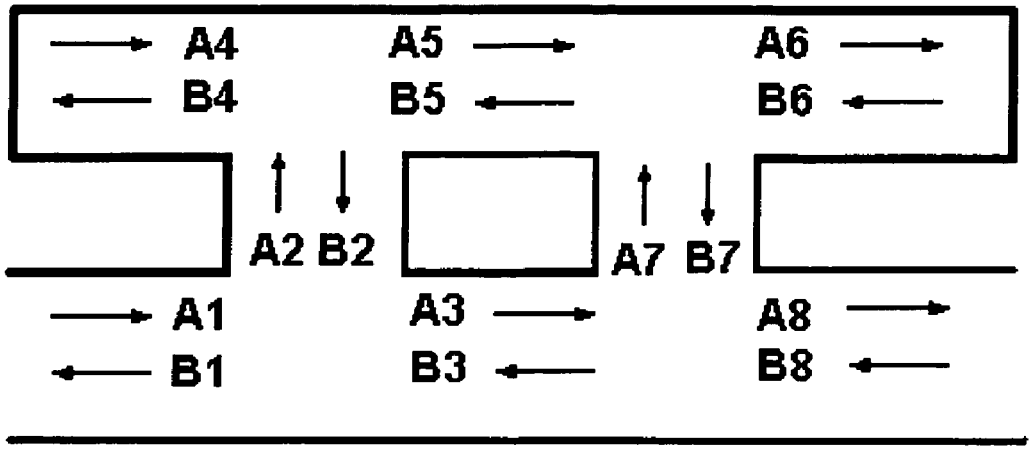
FIG. 3 is an acoustic wave schematic of the resonator of FIG. 2.
Figure 4:
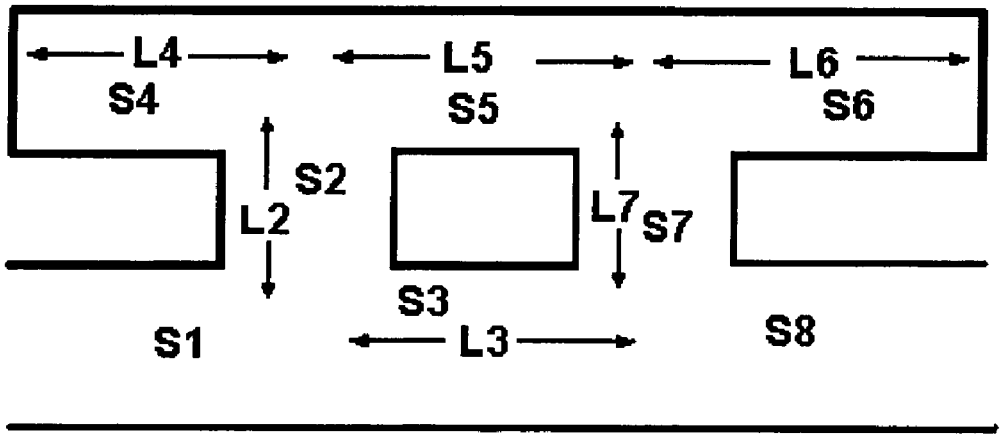
FIG. 4 is a pipe area/length schematic of the resonator of FIG. 2.

Another method is to use one-dimensional acoustic wave analysis to calculate transmission loss. Characteristic dimensions such as tube length, tube area, neck length, neck area, neck separation distance and neck location are modeled with acoustic waves according to the following acoustic wave equation:

$$p(x,\ t)=Ae^{i(wt+kx)}+Be^{i(wt+kx)} \quad \text{(Eq. 2)}$$

where the resonator is modeled with acoustic wave coefficients as shown in FIG. 3. The transmission loss is calculated according to the equation:

$$\text{Attenuation}=20\times\text{LOG}_{10}(P_{A1}/P_{A8}) \quad \text{(Eq. 3)}$$

where the resonator is modeled with the pipe area and pipe length as seen in FIG. 4.

In this method, one dimensional acoustic analysis is performed, again, using well known computational vibro-acoustic software such as SYSNOISE by LMS International. It is noted that the three dimensional analysis method described above will generally give more accurate and reliable results due to the complex three dimensional configurations that are possible according to the present invention.

Using either of the above methods for calculating transmission loss, an iterative process is used to tune the resonator to the desired resonance frequency as understood by those skilled in the art.

What is claimed is:

1. A resonator comprising:

a) a cavity having an effective length that exceeds λ/8 such that a standing wave having an anti-node will form in said cavity; and b) first and second necks each having first ends attached to and in fluid communication with said cavity, said first neck positioned adjacent said anti-node and thereby operable to interfere with said standing wave.

2. The resonator of claim 1 wherein said first and second necks each have a second end for attaching to an air intake duct.

3. The resonator of claim 2 wherein said second ends are located on opposite sides of said air duct.

4. The resonator of claim 2 wherein said second ends are no more than λ/16 apart from each other.

5. The resonator of claim 1 wherein said cavity has a curved configuration.

6. A method of designing a resonator for attaching to an air duct in a vehicle engine compartment, said method comprising the steps of:

a) providing a cavity having an effective length that exceeds λ/8 such that a standing wave having an anti-node will form in said cavity; and b) providing first and second necks each having first ends attached to and in fluid communication with said cavity, and positioning said first neck adjacent said anti-node and thereby operable to interfere with said standing wave.

7. The method of claim 6 wherein said first and second necks each have a second end for attaching to an air intake duct.

8. The method of claim 7 wherein said second ends are no more than λ/16 apart from each other.

9. The method of claim 7 wherein said second ends are located on opposite sides of said air duct.

10. The method of claim 6 wherein said cavity has a curved configuration.

11. A resonator comprising:

a) a cavity having an effective length that exceeds λ/8 such that a standing wave having an anti-node will form in said cavity; and b) first and second necks each having first ends attached to and in fluid communication with said cavity, said first neck positioned adjacent said anti-node and thereby operable to interfere with said standing wave, wherein said first and second necks each have a second end for attaching to an air intake duct, and wherein said first and second necks are located on opposite sides of said air duct and positioned along the same flow path plane.

12. The resonator of claim 11 wherein said cavity has a curved configuration.

* * * * *